US006745952B1

(12) United States Patent
Hlousek

(10) Patent No.: US 6,745,952 B1
(45) Date of Patent: Jun. 8, 2004

(54) FUEL INJECTOR WITH INTEGRATED FLOW RESTRICTOR

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 196 days.

(21) Appl. No.: 09/869,057

(22) PCT Filed: Oct. 20, 2000

(86) PCT No.: PCT/DE00/03693

§ 371 (c)(1),
(2), (4) Date: Sep. 27, 2001

(87) PCT Pub. No.: WO01/31193

PCT Pub. Date: May 3, 2001

Related U.S. Application Data

(63) Continuation-in-part of application No. 09/155,113, filed as application No. PCT/DE97/02053 on Sep. 13, 1997, now Pat. No. 6,431,148.

(30) Foreign Application Priority Data

Oct. 26, 1999 (DE) ..... 199 51 554

(51) Int. Cl.[7] ..... F02M 47/02; F02M 39/00; F02M 41/00; F02M 43/00; B05B 9/00

(52) U.S. Cl. ..... 239/88; 239/89; 239/91; 239/127; 239/533.3; 123/467

(58) Field of Search ..... 239/88, 89, 91, 239/127, 533.3, 90, 92, 124, 126, 533.2, 533.11, 585.1, 585.3, 585.4, 533.9, 533.12, 900, 585.5; 251/129.15, 129.21, 127; 123/467, 447, 456

(56) References Cited

U.S. PATENT DOCUMENTS 4,709,679 A * 12/1987 Djordjevic et al. ..... 123/447
5,497,750 A * 3/1996 Mueller et al. ..... 123/446
5,538,187 A * 7/1996 Mueller et al. ..... 239/88
5,941,215 A * 8/1999 Augustin ..... 123/467

FOREIGN PATENT DOCUMENTS

WO WO-9831933 * 7/1998 ..... F02M/63/00

* cited by examiner

*Primary Examiner*—Michael Mar
*Assistant Examiner*—Darren Gorman
(74) *Attorney, Agent, or Firm*—Ronald E. Greigg

(57) ABSTRACT

The invention relates to a fuel injection device for an internal combustion engine, having a common high-pressure collection chamber (common rail) that can be filled via a high-pressure pump. The high-pressure collection chamber communicates with injection valves, each of which includes a control valve embodied as a 3/2-way valve. Control faces are provided on the control part, which connect a high-pressure collection supply line to inflow lines to the injection nozzle or with a relief line, and the control part is actuatable by a controlled outflow line. The control part includes a throttle element, which via a bore communicates with a hollow chamber.

9 Claims, 2 Drawing Sheets

FUEL INJECTOR WITH INTEGRATED FLOW RESTRICTOR

CROSS-REFERENCE TO RELATED APPLICATIONS

This application is a 35 USC 371 application of PCT/DE 00/03693 filed on Oct. 20, 2000 and a continuation-in-part of U.S. application Ser. No. 09/155,113, filed Sep. 21, 1998, now U.S. Pat. No. 6,431,148, which was the National Stage of International Application No. PCT/DE 97/02053, filed Sep. 13, 1997.

BACKGROUND OF THE INVENTION

1. Field of the Invention

In fuel injection devices with fillable high-pressure collection chambers (common rails), injectors are used that can be subjected constantly to the extremely high system pressure, which on the one hand enables a largely delay-free injection of fuel, but on the other requires the prevention of even the least after-injections after the end of injection by means of a rapidly effected needle closure at the end of injection.

2. Description of the Prior Art

European Patent Disclosure EP 0 657 642 A2 relates to a fuel injection device for internal combustion engines. A high-pressure collection chamber (common rail) communicates constantly with the injection valves. To prevent the high system pressure from being applied constantly to the injection valves, the control valve is designed such that during the intervals between injections, it closes the communication of the injection component with the pressure reservoir and opens up a communication between the injection valve and a relief chamber. As a result, the closing forces to be exerted, which are brought to bear by spring forces, can be reduced. Increasingly stringent demands with regard to the level of the system pressure require higher closing forces, which necessitate springs that are dimensioned differently. The installation space available for the movable springs, however, is limited.

German Patent Disclosure DE 197 01 879 A1 also relates to a fuel injection device for internal combustion engines. By means of a triggerable magnet valve, a relief conduit, discharging into a work chamber that is under pressure, can be opened in such a way that the control valve can be moved into an opening or a closing position.

SUMMARY OF THE INVENTION

With the throttle element provided on the control part, it is possible, without having to turn to additionally required components or helical springs that generate greater closing forces, to achieve an increase in the closing force acting on the control part. This assures both faster closure of the nozzle needle at the end of injection and a tighter closure of the high-pressure collection chamber from the high-pressure collection supply line. Increasing the closing force at the control part prevents the occurrence of after-injections of even the tiniest fuel quantities, by increasing the pressure at the spring chamber. During the injection event, the spring chamber, with a spring element let into it, is subjected to the fuel, which is under high injection pressure. The pressure relief line provided next to the control part is closed by the control edges of the control part, so that during the injection, the high fuel pressure also prevails at the spring chamber and as a function of the opening time of the control part in the spring chamber, a fuel pressure builds up that promotes the process of restoration of the control part after the end of injection.

Opposite the control part, in its sleeve surrounding it, there is a further throttle element, which is provided in the pressure-free relief line. After the end of the injection event, the throttle in the relief line prevents cavitation from occurring in the injection nozzle. With appropriate dimensioning of the cross section of the throttle element, the spring chamber can on the one hand be completely pressure-relieved, and on the other a complete pressure relief of the spring chamber can be prevented by providing that by suitable dimensioning of the cross section of the throttle element, an increased residual pressure in the spring chamber can be preset and continue to be maintained.

Another advantage that can be attained with the provisions of the invention is that before the engine is first started, venting of the engine is attainable by means of the throttle element at the control part of the 3/2-way valve.

The effect of the provisions of the invention that is significant for the functional reliability of injection valves resides in a pressure equalization, effected via the throttle element, that is gradually established at the nozzle needle on the one hand and the spring chamber on the other through the throttle element and the bore, if malfunctions occur at the injection valve, for instance because a magnet valve has not closed or because of seizure or friction of the control part at its seat. The pressure equalization is established within a period of time. The available period of time for the pressure equalization via the cross section of the throttle element determines the maximum injection quantity at maximal system pressure. The maximum injection quantity, which exceeds the rated injection quantity, can be deflected, by suitable dimensioning of the cross section of the throttle element in the control part, in such a way that the engine will not suffer any damage if an injection event at the maximum injection quantity occurs.

With the thus mechanically controlled maximum injection quantity, electronic malfunctions in the form of missing or overly long trigger signals can also be compensated for.

BRIEF DESCRIPTION OF THE DRAWINGS

The invention will be explained in further detail below in conjunction with the drawings, in which.

DESCRIPTION OF THE PREFERRED EMBODIMENTS

Figure 1:
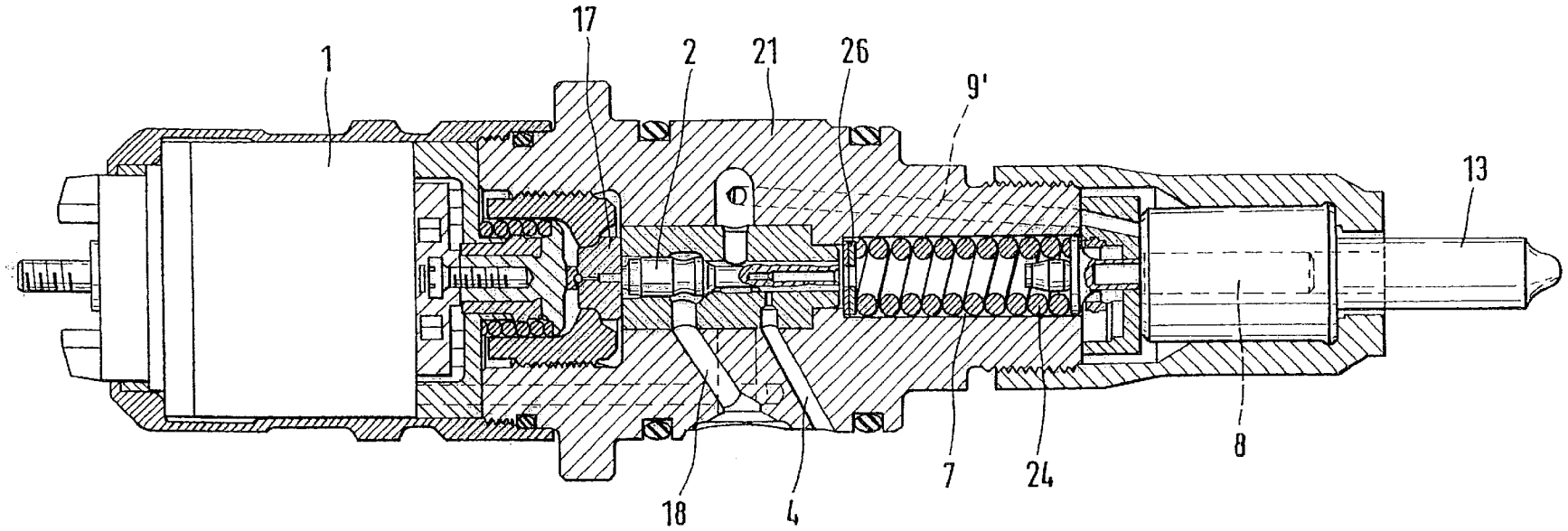
FIG. 1 shows an injector acted upon via a high-pressure collection chamber (common rail)

In the injector shown in FIG. 1 a 2/2-way valve, preferably embodied as an electrically triggerable magnet valve, is located on the end of the injector opposite the injection nozzle. The 2/2-way valve has the task of relieving a control chamber, provided above the control part 2—which is preferably embodied as a control slide—of the prevailing high pressure by opening a relief conduit. This causes fuel, which is at high pressure, in the supply line 18 to enter into communication with the high-pressure collection supply line 9, 9', which leads to the nozzle needle 8 of the injection nozzle 13. By means of the injection nozzle 13, the fuel present, which is at high pressure, is injected at the onset of injection into the engine combustion chamber in a quantity that is dimensioned in a defined way.

Figure 2:
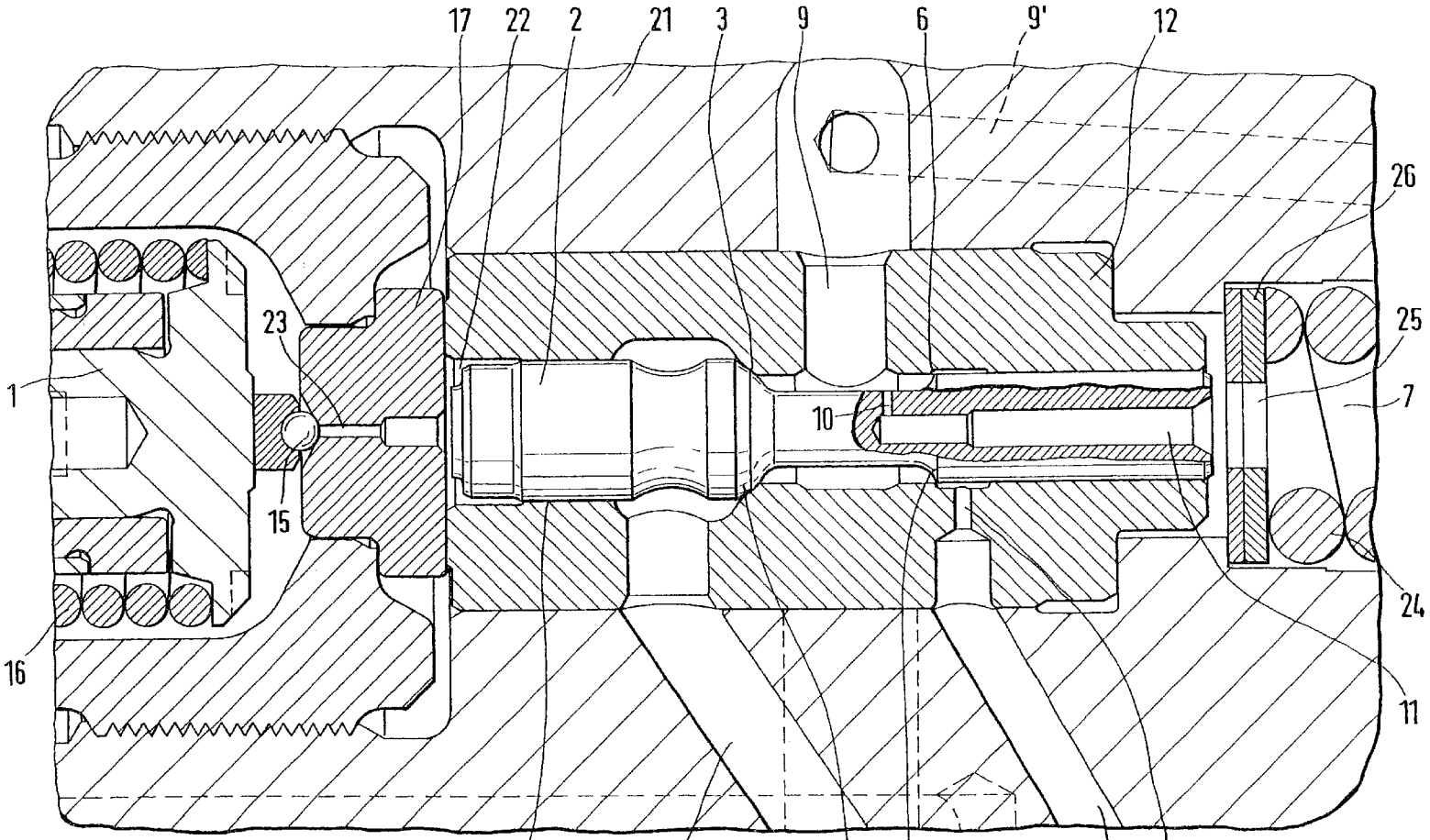
FIG. 2 shows an enlarged view of the control part of the 3/2-way valve between the magnet valve and the spring chamber.

The control part 2, which is shown in FIG. 2 on a larger scale and in more detail, is surrounded by a sleeve 12 that is provided with inflow and outflow bores for the fuel lines 4, 18 and for the high-pressure collection supply lines 9. The sleeve 12 is in turn let into a housing 21. Located in the housing 21 is a spring chamber 7, with a helical spring 24 let into it. The helical spring 24 is braced at one end on a pair of disks 25 and 26, while with its other end it rests on an annular insert, which receives a nozzle needle 8 with which the injection nozzle 13 can be opened and, after the end of injection, closed again.

The communication of the injector, shown in FIG. 1, with the high-pressure collection chamber (common rail) is effected via the high-pressure collection supply line 18. The high-pressure collection chamber is not shown further in FIG. 1. The pressureless relief line 4 pumps excess fuel into a fuel tank, also not shown. In comparison to the injector housing 21, which can be made from relatively inexpensive material, the sleeve 12 surrounding the control part 2 and the control part 2 itself are made from high-quality material. To minimize leakage losses that occur in the relative motion between the control part 2 and the sleeve 12 surrounding it, the control part 2 and the sleeve 12 are made to the closest possible tolerances with regard to one another.

FIG. 2, in a more detailed view, shows the control part 2, which is let into the housing 21 and is surrounded by a sleeve 12.

By means of the 2/2-way valve 1 received in the injector housing 21, a closing body 15 can be opened, which in the position of repose, in which it is acted upon via a spring element 16, closes a relief bore 23 provided in a stop 17. The relief bore 23 is embodied with only a slight flow cross sectional area, and as a result the relief bore 23 acts as a throttle. A high-pressure collection supply line 18 discharging into the injector housing 21 is shown, by way of which the injector is supplied with fuel at high pressure. The high-pressure collection supply line 18 from the high-pressure collection chamber (common rail) discharges into a bore in the sleeve 12. Upon triggering of the 2/2-way valve 1, the control part 2, preferably embodied as a control slide, uncovers the relief bore 23 discharging into a control chamber 22, as a result of which the pressure in the control chamber 22 decreases. This causes a motion of the control slide 2 to the stop face 17 that defines the bore 20 of the sleeve 12, which bore receives the control part 2.

When the pressure in the control chamber 22 is decreasing, the control part 2 opens at the valve seat 3, and fuel at high pressure shoots along the control shoulder 19 into the high-pressure collection supply lines 9, 9' leading to the injection nozzle 13. The course of the injection event can be varied definitively by the shaping of the control shoulder 19. The fuel at high pressure acts not only on the high-pressure conduits 9, 9' of the lines leading to the injection nozzle, but also on a throttle element 10 disposed in the control part 2, upstream of the control edges 5, 6. This throttle element 10—embodied for instance as an inexpensive bore in the control part 2—discharges into an axial bore 11 of the control part 2, which bore in turn discharges into an open space 7. Disks 25 and 26 on which the spring element 24 is braced are let into this hollow chamber of the injector housing 21. The other end of the spring element 24 is associated with the end of the hollow chamber 7 toward the nozzle needle 8.

During the injection event, the pressure in the spring chamber 7 is raised, as a function of the opening time of the control valve 2. This causes a pressure buildup in the hollow chamber 7 on the side remote from the nozzle needle 8 (FIG. 1). Toward the end of injection, that is, when the 2/2-way valve 1 closes, the pressure in the control chamber 22 accordingly rises, and the control part 2 moves toward the valve seat 3 in the control housing 21, and a pressure relief of the injection nozzle 13 takes place as a result of an uncovering of the relief line 4 by the control edges 5, 6 embodied on the control part 2.

Also embodied as a bore in the sleeve 12 surrounding the control part 2, there is a further throttle element 14, which is provided in the relief line 4. The further throttle element 14 prevents the fuel pressure from dropping abruptly to below the corresponding vapor pressure, so that cavitation is prevented by the further throttle element 14.

Since in the spring chamber 7 during the injection event a continuous pressure increase—in accordance with the opening time of the control part 2—has taken place, an increase in the rise in closing pressure for the control part 2 is attained by means of the closing motion of the control part 2 toward the spring chamber 7. As a result, any leakage occurring between the valve seat 3 and the control shoulder 19, which could lead to highly undesirable after-injections of fuel, is effectively averted.

Between the individual injection events, the spring chamber 7 can be relieved by the opening cross section of the throttle element 10. By means of the control edges 5, 6, fuel can flow back into the tank, not shown in detail, via the relief line 4. Depending on the selected cross section at the throttle element 10, a complete pressure relief of the spring chamber 7 can take place. Given suitable dimensioning of the throttle cross section at the throttle element 10 in the control part 2, a residual pressure dependent on the engine rpm can also be maintained in the spring chamber 7, as a result of which, at relatively high rotary speeds, the nozzle opening pressure can be raised.

When the engine is first started, venting of the combustion chambers of the engine can advantageously be done, making it easier to start the engine.

With the embodiment according to the invention, adverse effects of mechanical or electronic malfunctions can advantageously be averted. For instance, if a leak occurs at the 2/2-way valve 1, or if the spring 16 is broken, or the control part 2 seizes in the sleeve 12, the nozzle needle 8 on its seat is subjected to the same pressure as on the other side, where the same pressure gradually builds up via the throttle element 10, the bore 11 and the spring chamber 7. The period of time within which the gradual buildup of the pressure equalization occurs is determined by the throttle cross section at the throttle element 10. The period of time that the pressure equalization requires, at maximum system pressure at the nozzle needle 8, defines the maximum injection quantity. The maximum injection quantity, which exceeds the rated injection quantity, can be determined, by specification of the throttle cross section at the throttle element 10, such that when the maximum injection quantity is injected into the engine combustion chamber, the engine suffers no damage.

If an electronic malfunction in the form of an overly long trigger signal at the magnet valve 1 should occur, this malfunction can be compensated for mechanically by suitable dimensioning of the cross sectional area of the throttle element 10, since the maximum injection quantity is mechanically predetermined.

The foregoing relates to preferred exemplary embodiment of the invention, it being understood that other variants and embodiments thereof are possible within the spirit and scope of the invention, the latter being defined by the appended claims.

I claim:

1. In a fuel injection device for an internal combustion engine, having a common high-pressure collection chamber that can be filled via a high-pressure pump and that communicates with injection valves, which contain a control part (2) embodied as a 3/2-way valve which includes control faces (5, 6, 19) that connect a high-pressure collection supply line (18) with an injection line (9, 9') or with a relief line (4), the control part (2) being actuatable by means of a controlled outflow line (23), the improvement wherein the control part (2) includes a throttle element (10), which communicates with a hollow chamber (7) via a bore (11).

2. The fuel injection device of claim 1, wherein the bore (11) communicates with a nozzle inlet (9) via the throttle element (10).

3. The fuel injection device of claim 1, comprising a further throttle element (14), which prevents cavitation upon pressure relief of the injection nozzle (13), is included in the relief line (4).

4. The fuel injection device of claim 1, wherein, by closure of the relief line (4) by the control faces (5, 6) of the control part (2), the closing pressure exerted on the control part is increased.

5. The fuel injection device of claim 1, wherein by means of the dimensioning of the cross section of the throttle element (10), the hollow chamber (7) is completely pressure-relieved.

6. The fuel injection device of claim 1, wherein by means of the dimensioning of the cross section of the throttle element (10), a residual pressure in the hollow chamber (7) that increases the opening pressure of the injection nozzle (13) can be set.

7. The fuel injection device of claim 1, wherein by means of the throttle element (10), the hollow chamber (7) can be vented when the engine is first started.

8. The fuel injection device of claim 1, wherein by means of the throttle element (10), a pressure equalization between a nozzle needle (8) and the hollow chamber (7) is established at the control part (2) in the event of malfunctions of the control part (2).

9. The fuel injection device of claim 8, wherein by means of the cross section of the throttle element (10) when maximal system pressure is applied, the time difference in the pressure equalization that is established at the nozzle needle (8) can be predetermined, and thus the maximum injection quantity is defined.

* * * * *